United States Patent [19]

Cottingham

[11] Patent Number: 4,701,355

[45] Date of Patent: Oct. 20, 1987

[54] METHOD OF ARTIFICIALLY AGEING WOOD

[75] Inventor: Richard L. Cottingham, Uckfield, England

[73] Assignee: Timber Textures (UK) Limited, Tunbridge Wells, England

[21] Appl. No.: 716,249

[22] Filed: Mar. 26, 1985

[30] Foreign Application Priority Data

Mar. 29, 1984 [GB] United Kingdom ..... 8408137

[51] Int. Cl.[4] ..... B05D 3/02

[52] U.S. Cl. ..... 427/317; 427/393; 427/444

[58] Field of Search ..... 427/317, 393, 444, 223

[56] References Cited

U.S. PATENT DOCUMENTS

| | | | |
|---|---|---|---|
| 1,139,470 | 5/1915 | Aylsworth | 427/317 |
| 1,399,838 | 12/1921 | Abbey | 427/317 |
| 1,574,662 | 2/1926 | Leedom | 427/223 |
| 1,999,259 | 4/1935 | Rozema | 427/317 |
| 2,363,658 | 11/1944 | Decker | 427/393 |
| 2,431,148 | 11/1947 | Stover | 427/223 |
| 2,867,543 | 1/1959 | Braun | 427/317 |
| 3,069,290 | 12/1962 | Berry | 427/393 |
| 3,166,434 | 1/1965 | Gauger | 427/317 |
| 3,678,595 | 7/1972 | Fagerstrom | 427/393 |
| 3,932,199 | 1/1976 | Lucht et al. | 427/223 |
| 4,112,144 | 9/1978 | Ellis | 427/223 |
| 4,170,668 | 10/1979 | Lee et al. | 427/223 |
| 4,181,763 | 1/1980 | Shellenberger | 427/223 |
| 4,210,702 | 7/1980 | Dalibor | 427/393 |
| 4,252,863 | 2/1981 | Song | 427/317 |
| 4,289,813 | 9/1981 | Blomeyer et al. | 427/393 |
| 4,442,145 | 4/1984 | Probst et al. | 427/393 |

FOREIGN PATENT DOCUMENTS

| | | | |
|---|---|---|---|
| 328 | of 1862 | United Kingdom | 427/223 |

OTHER PUBLICATIONS

"The Sugi Finish", The Craftsman, May 1912, Craftsman Publishing Co., New York, p. 220.

*Primary Examiner*—Sadie L. Childs

*Attorney, Agent, or Firm*—Fleit, Jacobson, Cohn & Price

[57] ABSTRACT

A method for artificially ageing wood in which the surface of the wood is subjected to the action of at least one jet of high velocity, high temperature gas, whereby the surface of the wood is scorched, and wherein a lacquer is subsequently applied to the treated surface.

5 Claims, 1 Drawing Figure

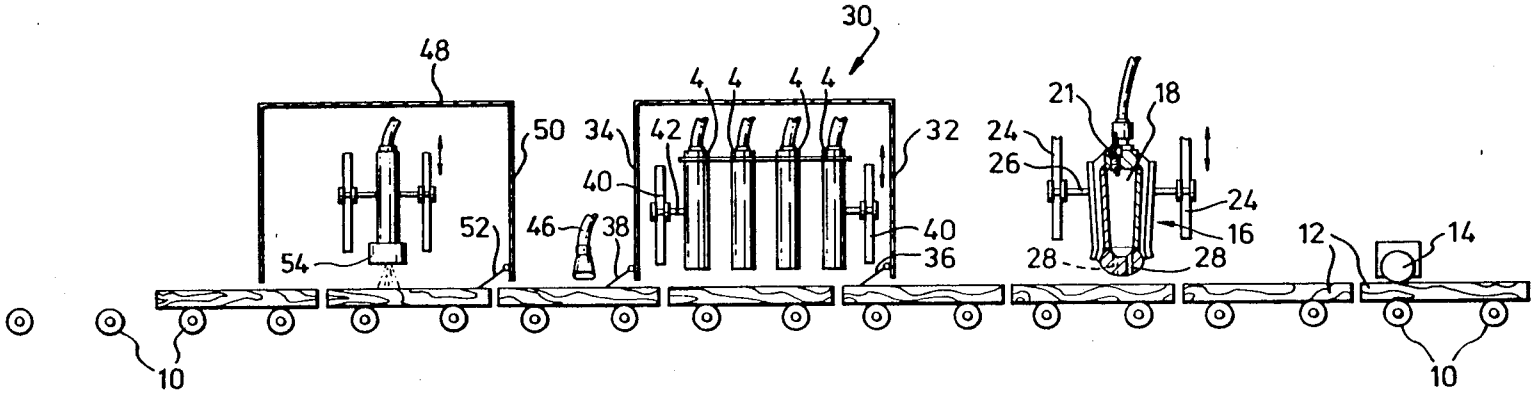
10
14
12
24
16
28
18
21
24
26
28
32
40
36
30
44
44
42
34
40
38
46
50
52
48
54
10

METHOD OF ARTIFICIALLY AGEING WOOD

The present invention relates to a method of and apparatus for artificially ageing wood.

It is very often desirable, from an aesthetic point of view to make wood structures which appear to be relatively old and yet are made at the present time using good quality fresh wood which will have the necessary structural strength.

Various proposals have been made to age the wood including subjecting it to shot or sand blasting but none of these is fully satisfactory.

It is now proposed, according to the present invention, to provide a method of artificially ageing wood comprising subjecting the surface of the wood to the action of at least one jet of high velocity, high temperature gas, whereby the surface of the wood is scorched and subsequently applying a lacquer to the thus treated surface.

With such a method very striking results can be achieved. The whole of the surface of the wood is scorched by the high temperature gas jet and those parts of the scorched surface which lie between the grain of the wood are blown away by the jet, so that one is left with the grain itself standing out very slightly. This gives a very good impression of ageing.

If one treats the portions of the wood including knots slightly more than the remainder, then an even better effect is achieved, because the knots themselves are formed of harder wood and it is these which accentuate the ageing effect. In fact the action of the jets causes a slight crazing of the knot portions of the wood which adds to the apparent age.

If desired, one can subject the wood to the action of a shot blast, e.g. a sand blast, prior to the application of the lacquer. This again provides a beneficial effect.

The purpose of the lacquer is to prevent the scorched effect which particularly remains on the grained parts of the wood rubbing off and in fact dirtying the hands of the user. The lacquer may take any suitable form, but very good results have been obtained using a matt clear polyurethane lacquer.

The jet or jets may be produced by a burner comprising a combustion chamber in which, in use, a fuel/air mixture is burned in a flash back condition, i.e. in which combustion is complete in the chamber, the flame being always in the chamber, and also having an ignition device at the inlet of the chamber and an outlet nozzle, by which the hot gases produced in the combustion chamber of the mixture issue and can be directed to form said jet or jets.

Such burners usually burn gaseous fuels such as propane, and can produce temperatures of the order of 1100° to 1650° C. and the velocity of the jet or jets is of the order of 300 meters per second.

The combustion chamber itself may be similar to that disclosed in British Patent Specification No. 1556753 but instead of having one row or orifices they are preferably at least two rows of orifices, the orifices of one row being staggered relative to those of the adjacent row or rows.

Such an arrangement can be mounted above the path of the wood which itself can then be passed under the combustion chamber to provide the scorching effect. Alternatively, the whole effect can be achieved by manually operating the burner, or mounting the burner on a moving trolley or gantry and holding the wood stationary.

In order that the present invention may more readily be understood, the following description is given, merely by way of example, reference being made to the accompanying drawing in which the sole FIGURE is a schematic side elevation, in section, of one embodiment of apparatus according to the invention.

Referring to the drawings there is illustrated a conveyor comprising a plurality of freely rotatable parallel rollers 10 upon which can be mounted several lengths of wood 12 is to be treated. The wood is caused to be moved over the rollers 10 by means of a drive roller 14 which can be sprung urged downwardly against the upper surface of a length of wood at the upstream (righthand) end of the conveyor 10. Thus the righthand most length of wood will push the lengths of wood to its left as seen in the drawings, along the conveyor formed by the rollers 10. Alternatively the rollers could be driven.

Mounted above the wood 12 is a burner indicated by the general reference numeral 16. This is a general type disclosed in British Patent Specification No. 1556753 and includes a combustion chamber 10 and a fuel pipe 20 and an air supply 22. An ignition device 21 is mounted adjacent the inlet to the combustion chamber and a baffle 23 is provided to deflect the incoming air and gas.

Two vertically extending guide rails 24 are mounted on each side of the combustion chamber 18 and a support bar is connected at the combustion chamber and can be adjustably positioned on the guide rails so that the actual position of the combustion chamber itself can be vertically adjusted. The lower part of the combustion chamber is provided with discharge orifices 28 which are arranged in two parallel rows, with the orifices of the rows being staggered relative to one another, to produce jets being arranged in at least two rows with the jets of one row being staggered relative to the jets of the adjacent row.

Downstream of the burner 16 is a blasting cabinet 30 having front and rear walls 32, 34 provided with a front flap 36 and a rear flap 38 respectively. In the cabinet there are vertical guide rails 40 and a generally horizontally extending support bar 42 vertically adjustable on the guide rails, the support bar carrying a number, as shown 4, of vertically extending sand blasters. The horizontal and vertical positions of these sand blasters can be adjusted.

Immediately adjacent the rear flap 38 and outside the cabinet 30 is an air jet 46.

Downstream to this is a spray cabinet 48 having a front wall 50 provided with a flap 52 and vertically adjustable within the spray cabinet is a spray head 54.

In use of the above described apparatus, the wood is placed, as described above, on the conveyor formed by the rollers 10 and is caused to move to the left. Gas is combusted into the chamber 18 in a flash back condition i.e. in which combustion is complete in the chamber, the flame being always in the chamber, and a plurality of jets of very hot high speed combustion gases are projected downwardly on the wood. This has the effect scorching the wood and those parts of the scorched surface which lie between the grain of the wood are blown away by the jet, so that one is left with the grain itself standing out very slightly.

The wood then proceeds into the cabinet 30 in which it is subjected to the action of the blasters which can either blast a relatively soft material such as sand or preferably a harder material such as carborundum or copper slag. This has the effect of blasting away some of the softer parts of the wood also.

The air jet 46 blows away any residual blasting medium and the latter preferably being recycled in the cabinet 30.

The thus treated wood then moves into the spray cabinet 48 so it is subjected to the action of a primer lacquer such as matt polyurethane, which replaces the wood resin which has been scorched and blasted out. The lacquer also prevents the scorched effect on the grain and knots from rubbing of and dirtying the hands of a user.

The hot jets and sand blast jets are preferably projected vertically downwardly.

I claim:

1. A method of artificially ageing wood comprising the steps of:

establishing a combustion zone, introducing into the combustion zone a fuel/air mixture, igniting the fuel/air mixture as it enters the combustion zone, combusting the fuel/air mixture completely within the combustion zone with the flame being only in the combustion zone to produce hot combustion gases, leading the hot combustion gases from the combustion zone to an issue zone, projecting from the issue zone at high speed at least one jet of hot combustion gases against a surface of a length of wood, the surface being made up of wood grain and softer wood therebetween, moving the length of wood relative to the projected high speed hot combustion gases to subject the whole of the surface of the length of wood to the high speed hot combustion gases to scorch the whole surface of the length of wood and to blow away the scorched softer wood of the surface and to leave the grain of the surface standing out slightly, and subsequently applying a lacquer to the thus treated surface.

2. A method according to claim 1, and further comprising the step of subjecting said surface of the wood to shot or sand blasting after being subjected to the action of said at least one jet.

3. A method according to claim 1, wherein knots in the surface of the wood are subjected to the action of said at least one jet for longer than the remainder of the surface.

4. A method according to claim 1, wherein the lacquer is matt clear polyurethane lacquer.

5. A method of artificially ageing wood as claimed in claim 1, wherein a plurality of jets are projected from the issue zone said jets being arranged in at least two rows with the jets of one row being staggered relative to the jets of the adjacent row.

* * * * *